US005727841A

United States Patent [19]

Morley

[11] Patent Number: 5,727,841

[45] Date of Patent: Mar. 17, 1998

[54] REMOVABLE ACCESSORY FOR LOUNGE CHAIR

[76] Inventor: Brian D. Morley, 1955 Williamsbridge Rd., Bronx, N.Y. 10461

[21] Appl. No.: 696,646

[22] Filed: Aug. 14, 1996

[51] Int. Cl.[6] ..... A47C 7/62

[52] U.S. Cl. ..... 297/188.06; 297/184.1

[58] Field of Search ..... 297/183.5, 188.2, 297/188.12, 188.13, 188.06, 188.07, 220, 397, 184.1, 184.15, 184.17; 224/155, 275

[56] References Cited

U.S. PATENT DOCUMENTS

| | | | |
|---|---|---|---|
| D. 362,579 | 9/1995 | Short . | |
| 900,572 | 10/1908 | Morton | 297/184.15 |
| 2,566,757 | 9/1951 | Alexander | 297/188.06 X |
| 2,589,013 | 3/1952 | Martin | 297/183.5 X |
| 3,154,345 | 10/1964 | Lambrecht . | |
| 3,290,089 | 12/1966 | Farrell . | |
| 3,848,267 | 11/1974 | De Spain . | |
| 3,863,283 | 2/1975 | Mohr . | |
| 4,072,345 | 2/1978 | Matsuda | 297/184.1 X |
| 4,487,345 | 12/1984 | Pierce et al. | 297/188.07 X |
| 4,535,878 | 8/1985 | Grahl . | |
| 4,597,605 | 7/1986 | Gilbert . | |
| 4,652,048 | 3/1987 | Nazar | 297/188.13 |
| 4,688,286 | 8/1987 | Miker, Jr. . | |
| 4,725,094 | 2/1988 | Greer . | |
| 4,854,637 | 8/1989 | McCree . | |
| 4,877,288 | 10/1989 | Lee . | |
| 5,096,257 | 3/1992 | Clark | 297/184.15 |
| 5,199,120 | 4/1993 | Holmes . | |
| 5,203,363 | 4/1993 | Kidwell et al. | 297/184.15 X |
| 5,240,330 | 8/1993 | Thompson . | |
| 5,275,463 | 1/1994 | Rocha . | |
| 5,475,886 | 12/1995 | Mintz . | |
| 5,538,323 | 7/1996 | Henkel | 297/220 X |

FOREIGN PATENT DOCUMENTS

| | | | |
|---|---|---|---|
| 625443 | 11/1994 | European Pat. Off. | 224/155 |
| 1238905 | 7/1960 | France . | |
| 570798 | 12/1957 | Italy | 297/184.1 |

*Primary Examiner*—Milton Nelson, Jr.
*Attorney, Agent, or Firm*—Mark P. Stone

[57] ABSTRACT

A lounge chair accessory is removably mounted to the back of the chair. The accessory includes a front surface adjacent to the body of a user seated within the chair for providing a pillow and back cushion, and a rear surface extending rearwardly from the chair providing storage compartments for storing various items including cold beverages. The accessory is foldable into a compact unit when removed from the back of the lounge chair, and straps are provided for carrying the compact unit either by hand or as a backpack. In the alternative, the accessory can remain mounted to the chair when the chair is folded, and both the chair and the accessory can be carried as a single unit. The front surface of the accessory can be pivoted relative to the back of the lounge chair to provide a sun cover over the head of the user instead of employing the front surface of the accessory as a pillow or as a back cushion.

14 Claims, 4 Drawing Sheets

REMOVABLE ACCESSORY FOR LOUNGE CHAIR

BACKGROUND OF THE INVENTION

The present invention is directed to accessories for lounge chairs, and in particular covers removably mounted to the backrest portions of pool chairs, beach chairs and the like.

Known lounge chair covers and accessories are exemplified by U.S. Pat. Nos. 4,877,288; 4,725,094; 5,240,330; 4,854,637; 4,597,605; 5,475,886; 5,275,463; 4,535,878; 3,848,267; and Des. 362,579. Moreover, U.S. Pat. Nos. 5,199,120; and Des. 362,579. Moreover, U.S. Pat. No. 4,688,286 and 3,863,283 illustrate pillows defining storage compartments, and U.S. Pat. Nos. 3,290,089; 3,154,345; and French Patent No. 1,238,905 exemplify typical folding chairs.

It is the primary object of the present invention to provide an improved accessory which is removably mounted to a beach or lounge chair, or other chair which is typically used for recreational purposes at the beach, poolside, camping or the like. In accordance with the present invention, the accessory includes compartments for storage of items used on recreational outings; the accessory provides head and backrests; the accessory may be readily transported by the user when it is removed from the chair or can, at the selection of the user, remain mounted to the chair and carried as a single unit together with the folded chair; and the accessory provides means for selectively blocking sunlight from the head of a user occupying the chair. Other advantages and improvements of the present invention will become apparent from the following description.

SUMMARY OF THE INVENTION

The present invention provides an accessory for a chair, and in particular a foldable lounge or beach chair, including means for removably mounting the accessory to a backrest portion of the chair when the chair is in its unfolded operational position. A front surface of the accessory, which is adjacent to the body of a person seated in the chair, defines a pillow at the top portion thereof and a backrest at the lower portion thereof. A rear surface of the accessory extends backwards from the rear surface of the backrest of the chair and defines a plurality of compartments for storing various items used on recreational outings, including an insulated compartment for storing cold beverages and perishable foods.

In the preferred embodiment of the invention, means are provided for pivoting the front surface of the accessory relative to the rear surface of the accessory and the backrest of the chair so that the front surface, in its extended pivoted position, provides a sun cover for the occupant of the chair, at the selection of the occupant. Conventional means, as for example, ratchet means, are provided to pivot the front surface into its extended position, retain the front surface in its extended position, and pivot the first surface back into its initial position adjacent to the backrest of the chair, as desired by the user.

The accessory includes straps extending therefrom to permit the user to readily transport it by hand or, in the alternative, carry it as a backpack. In this manner, the accessory, when removed from the chair, can be readily transported together with the chair, from, for example, a car to the beach or from the beach back to the car. In the alternative, the accessory can remain mounted to the chair when the chair is folded into its compact, storage position, and the accessory and the chair can be carried together as a single unit.

DESCRIPTION OF THE BEST MODES FOR CARRYING OUT THE INVENTION

Figure 2:
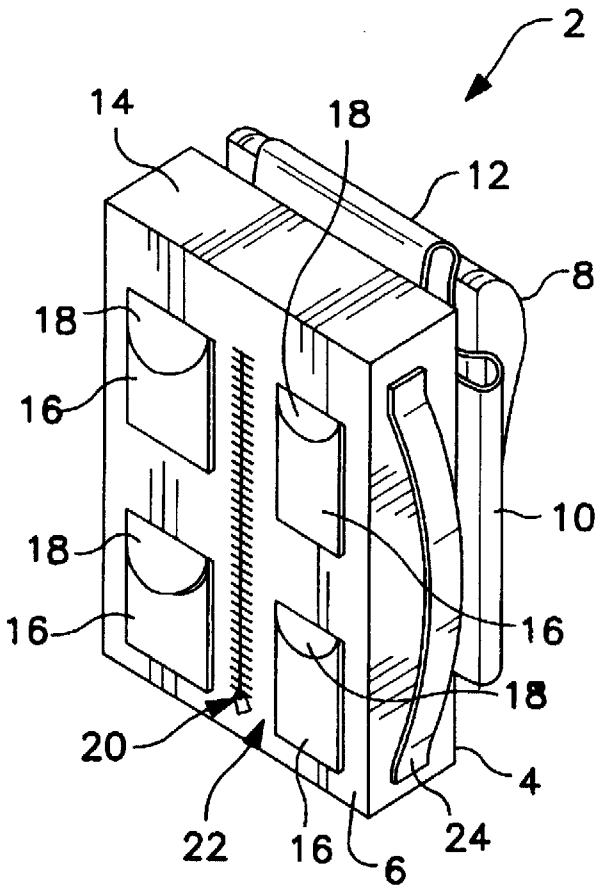
FIG. 2 illustrates a perspective view of the accessory of FIG. 1, taken from the rear surface thereof.
Figure 1:
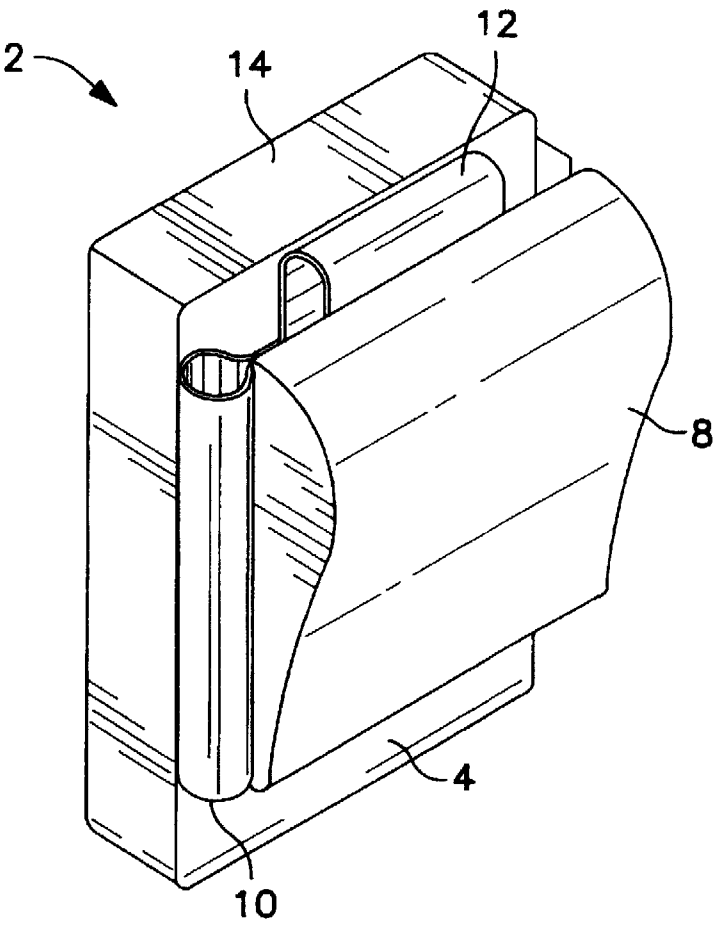
FIG. 1 of the drawing is a perspective view of an accessory in accordance with the present invention, taken from the front surface thereof.

FIGS. 1 and 2 of the drawing illustrate a perspective view of the front and rear of an accessory in accordance with the present invention, in its compact folded position and not mounted to the backrest of a chair. The accessory, which is generally designated by reference numeral 2, includes a front surface generally designated by reference numeral 4, and a rear surface generally designated by reference numeral 6. The front surface defines a pillow 8 extending forwardly therefrom, and a pair of opposed mounting elements 10, which are illustrated as looped straps adjacent to the opposed sides of the pillow 8 and positioned proximate to the opposed end of the front surface 4. (only the right mounting element 10 is illustrated in FIGS. 1 and 2. The left mounting element is of identical configuration and arrangement). A top mounting element designated by reference numeral 12 extends across the top surface of the pillow 4 proximate to the center of the top edge 14 of the accessory 2. Preferably, the pillow cover and all of the exposed surfaces of the accessory 2 are formed from a waterproof nylon material. As will be discussed herein, the opposed side mounting elements 10 and the top mounting element 12 are adapted to be removably received, respectively, on the side and top supports of the backrest of a chair for removably mounting the accessory to the chair. A space is provided between the rear surface of the pillow and the front surface 4 of the accessory to permit the accessory to be slid on and off of the backrest of a chair.

Referring to FIG. 2, the rear surface 6 of accessory 2 defines a plurality of storage compartments or pockets 16 including means for releasably locking the pockets in a closed position. Such means are conventional and include closure flaps 18 mounted proximate to the top of the pockets and conventional closure elements, as for example, hook and loop structures or snap fitting locking elements. A larger storage compartment 22 is defined behind the individual compartments 16, and access to the larger storage compartment is provided through a zipper 20 centrally disposed and vertically oriented on the rear surface 6 of the accessory 2. In accordance with a preferred embodiment of the invention, the larger storage compartment can be lined with a heat insulating material to provide compartment means for storing cold beverages, perishable foods, and other materials needing protection from excessive heat. As illustrated by FIG. 2, the storage compartment 22 is generally square or rectangular in shape to conform to the shape of the rear surface 6 of the accessory 2, and the depth of the storage compartment 22 is defined substantially by the distance between the rear surface 6 and the front surface 4 of the accessory 2. FIG. 2 also illustrates a carrying strap 24 attached to one end of the accessory 2 to facilitate carrying the accessory when it is removed from a chair. In the alternative, the accessory 4 can remain mounted to the chair when the chair is folded so that the folded chair and the accessory can be transported and stored as a single unit.

Figure 3:
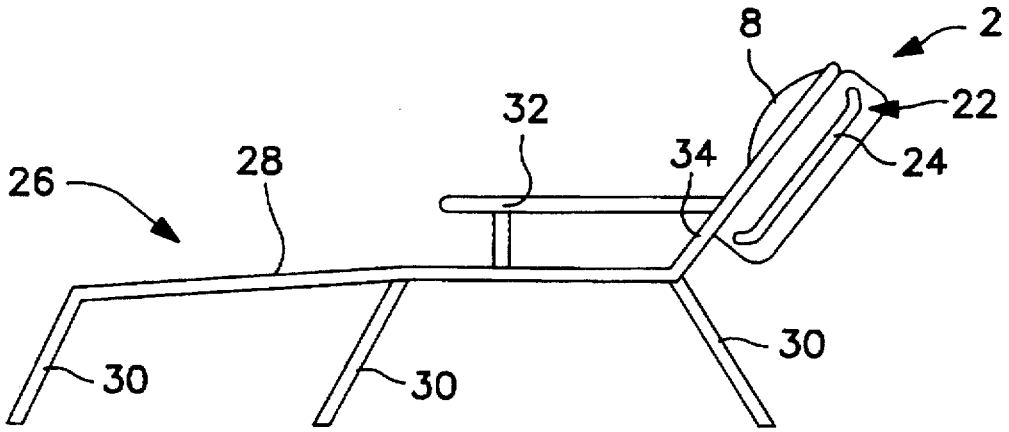
FIG. 3 illustrates a side elevational view of the accessory illustrated in FIGS. 1 and 2, mounted to the backrest of a chair.
Figure 4:
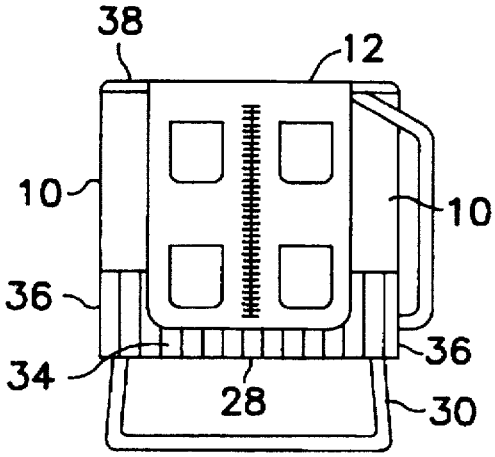
FIG. 4 illustrates a rear elevational view of the accessory mounted to the backrest of the chair shown in FIG. 3.
Figure 5:
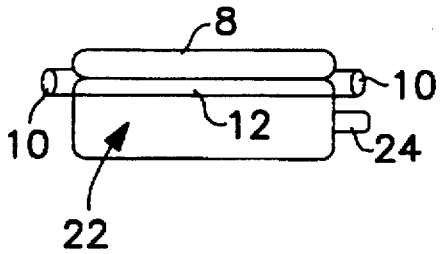
FIG. 5 illustrates a top plan view of the accessory mounted to the backrest of the chair, as shown in FIG. 3.

FIG. 3 illustrates a side elevational view of the accessory 2 illustrated by FIGS. 1–2, mounted to a chair 26. The chair 26 is a typical foldable-type beach or lounge chair including a horizontal portion 28, a plurality of legs 30, an armrest 32, and a backrest 34. The accessory 2 is mounted to the backrest 34 by sliding the two opposed mounting elements 10 downwardly and over opposed sides 36 of a supporting frame for the backrest 34, until the top supporting element 12 is received on a top portion 38 of the supporting frame Of the backrest 34 of the chair, as is best shown by FIGS. 4 and 5. When the accessory 2 is removably mounted to the backrest of the chair as illustrated by FIG. 3, the pillow 8 is positioned proximate to the top of the backrest to accommodate the head of a user seated in the chair. The accessory 2 can be removed from the backrest of the chair by merely sliding it upwardly relative to the backrest until the top mounting element 12 and the two opposed side mounting elements 16 are completely disengaged from the backrest of the chair. A space is provided between the rear surface of the pillow 8 and the front surface 4 of the accessory 2 to enable the accessory to be received on the backrest of the chair and removably retained thereon by the side mounting elements 10 and the top mounting element 12. As illustrated by FIG. 3 of the drawing, the backrest 34 of the chair is disposed between the front surface 4 of the accessory and the rear surface of the pillow 8 when the accessory 2 is in its operating position removably mounted to the backrest of the chair.

Figure 6:
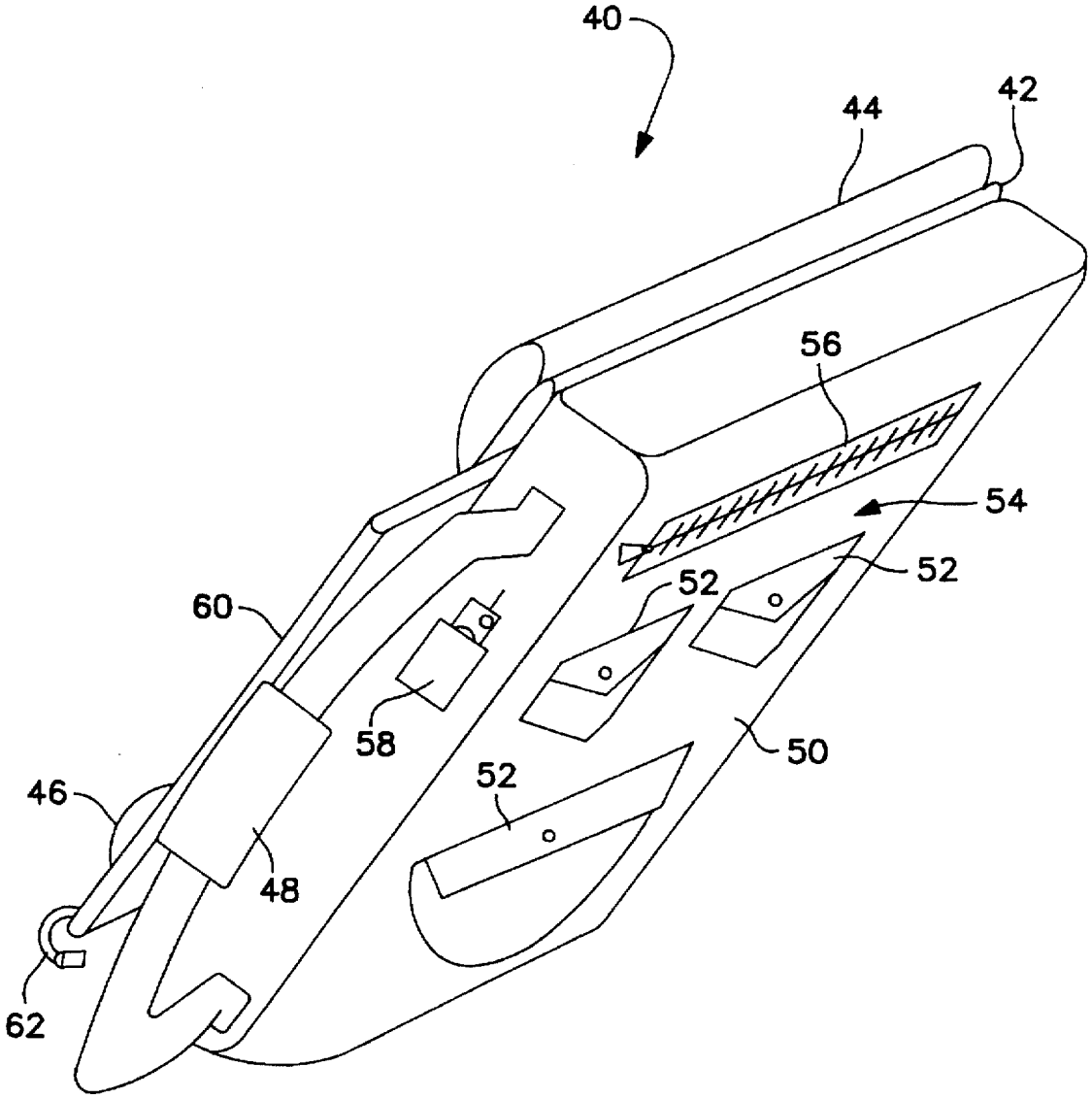
FIG. 6 illustrates a perspective view of a modified embodiment of the accessory in accordance with the present invention.

FIG. 6 illustrates a second embodiment of the accessory in accordance with the present invention, which is shown removed from a chair. The accessory, generally illustrated by reference numeral 40, includes an upper mounting element 42, corresponding to element 12 shown and discussed with respect to the first embodiment of the invention. Mounting element 42 is adapted to being received on the top edge of the backrest of a chair for removably mounting the accessory 40 to the backrest of the chair. The front surface of the accessory 40 includes a head support or pillow 44 provided at the top thereof, and a back support 46 provided at the lower portion thereof. A carrying strap 48 extends from one end of the accessory 40. Moreover, it is within the scope of the invention to provide a second carrying strap on the other end of the accessory 40 so that the accessory may be transported as a backpack when it is removed from the backrest of a chair. As previously noted herein, it is further within the scope of the present invention to permit the accessory to remain mounted to the chair so that the accessory and the folded chair can be transported and stored as a single unit, at the selection of the user. The rear surface of a rear portion 50 of the accessory 40 defines a plurality of storage compartments 52 which are of different size and arranged in a different manner than the pockets illustrated on the rear surface of the first embodiment of the invention. A larger storage compartment 54, which can be a heat insulated compartment, is defined within the accessory 40, and a zipper 56 is provided for gaining access to the storage compartment 54. In the embodiment of the invention illustrated by FIG. 6, the zipper is oriented horizontally relative to the accessory 40, and not vertically as illustrated with respect to the first embodiment of the invention. The embodiment illustrated by FIG. 6 also provides a side storage pocket 58.

Still referring to FIG. 6, the front surface of the accessory 40 is designated generally by reference numeral 60, and the front surface 60 carries the pillow 44 and the backrest 46 thereon. A strap 62 extends from the bottom edge of the front surface 60 for removably connecting the front surface to the remaining portion 50 of the accessory. In the preferred embodiment of the invention, the strap 62 is formed, in part, from VELCRO material and a VELCRO strip is affixed to a corresponding area of portion 50 of the accessory. Means disposed between the upper portion of the front surface 60 and the upper mounting strap 42 are provided for selectively pivoting the front surface 60 relative to both the upper mounting element 42 and the rear portion 50 of the accessory 40 which remain mounted in a fixed position relative to the backrest of a chair. The pivot means, which are conventional, are provided for selectively pivoting the front surface 60 relative to the fixed rear portion 50 of the accessory (and the backrest of the chair), maintaining the extended front surface in a fixed extended position relative to the rear portion 50 as selected by the user, and disengaging the pivot means to return the upper surface 60 to its initial position adjacent to the rear portion 50 at the selection of the user. This feature of the invention is explained as follows with respect to FIGS. 7–10 of the drawing.

Figure 7:
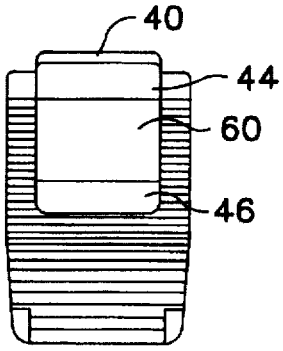
FIGS. 7–10 illustrate, schematically, an accessory in accordance with the present invention mounted to the backrest of a chair in which the front surface of the accessory is pivoted into an extended sun cover position.
Figure 8:
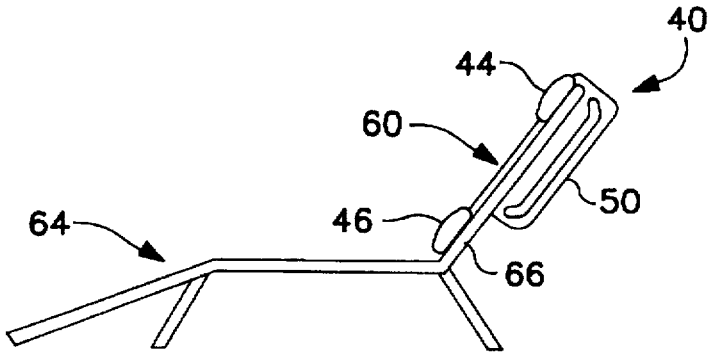

Referring to FIGS. 7–10 of the drawing, FIG. 7 illustrates a front view of the accessory 40 mounted to the backrest of a chair in a starting position in which the pillow and the backrest carried on the front surface of the accessory are adjacent to the front surface of the backrest of the chair. FIG. 8 illustrates a side elevational view of the accessory mounted to a chair in the position shown by FIG. 7. The chair is generally designated by reference numeral 64, and the backrest of the chair is generally designated by the reference numeral 66.

Figure 9:
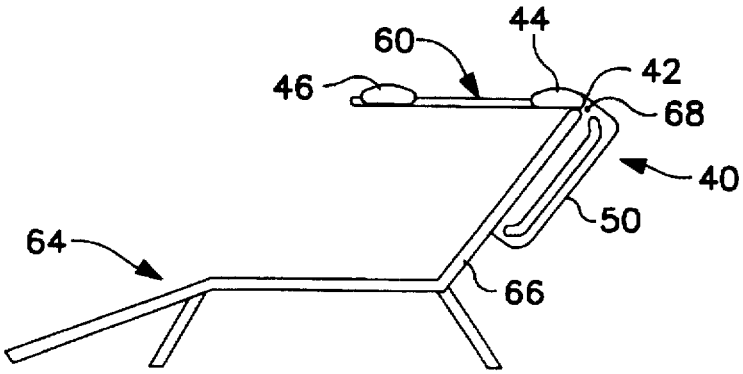
Figure 10:
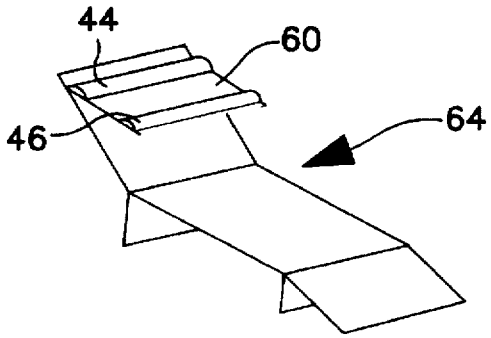

FIG. 9 illustrates a side elevational view of FIG. 8 when the front surface 60 of the accessory is pivoted relative to the rear portion 50 of the accessory. As noted, the rear portion 40 remains in a fixed position relative to the backrest 66 of the chair 64 and is maintained in that fixed position as a result of the engagement between the upper mounting element 42 which is removably received on the top edge of the backrest of the chair. The front surface 60 of the accessory 40 is pivoted relative to the rear portion 50 along pivot axis 68 which is located slightly below the top of the backrest of the chair. The means for pivoting the front surface 60 relative to the rear portion 50 is conventional and includes conventional ratchet means to enable the user of the accessory to selectively pivot the front surface 60 relative to the backrest of the chair into the extended position illustrated by FIG. 9 in which the front surface 60 now provides a top sun cover for the head and upper body of the occupant of the chair 64. FIG. 10 is a perspective view of the chair 64 with the accessory 40 mounted thereto in the extended position of the top surface 60.

When the accessory is in its extended position to provide a sun cover for an occupant seated in the chair as illustrated by FIGS. 9 and 10, the occupant is unable to utilize the pillow 44 or the back support 46. If the occupant subsequently elects to use these features of the invention, the top surface 60 is pivoted into its initial position as shown by FIG. 8 in which the sun cover is eliminated, and the pillow and back support are again provided for the occupant's use. Accordingly, the device in accordance with the present invention will provide head support and back support without a sun cover, or will provide a sun cover without head or back support, as selected by the user.

Other modifications, features and advantages within the present scope of the present invention will become apparent to those skilled in the art. Accordingly, the discussion of the preferred embodiments herein are illustrative only and not restrictive of the scope of the invention, that scope being defined by the following claims and all equivalents thereto.

I claim:

1. An accessory for a chair, said accessory including;

a front and rear portion and means for removably mounting said front and rear portion to a chair such that a backrest portion of said chair is disposed between said front portion and said rear portion of said accessory;

means for selectively pivoting said front portion relative to said rear portion between a retracted position in which said front portion is substantially adjacent to said rear portion and an extended position in which said front portion is separated from said rear portion when said accessory is mounted to said chair;

said front portion providing a sun cover for an occupant of said chair when said front portion is pivoted into said extended position relative to said rear portion;

said rear portion being fixedly mounted relative to said chair when said front portion is pivoted between said retracted and extended positions;

said accessory being removably mountable to said backrest of said chair;

said front portion carrying support means for the occupant of said chair when said front portion is in said retracted position relative to said rear portion; and said rear portion defining, at least in part, a heat insulated storage compartment.

2. The accessory as claimed in claim 1, wherein said means for pivoting said front portion relative to said rear portion further includes means for releasably retaining said front portion in a selected position separated from said rear portion.

3. An accessory for a chair, said accessory including:

a front surface and a rear surface connected to each other;

means for removably mounting said accessory to a chair;

said front surface defining thereon support means for an occupant of said chair to which said accessory is mounted;

said rear surface defining, at least in part, storage means;

means for selectively pivoting said front surface relative to said rear surface between a retracted position in which said front surface is substantially adjacent to said rear surface, and an extended position in which said front surface is separated from said rear surface, said front surface providing a sun cover for an occupant of said chair to which said accessory is mounted when said front surface is pivoted into its extended position;

said accessory being removably mounted to said chair such that a backrest portion of said chair is disposed between said front surface and said rear surface of said accessory.

4. The accessory as claimed in claim 3 wherein said storage means includes a heat insulated compartment defined within said rear surface.

5. The accessory as claimed in claim 3 wherein said means for removably mounting said accessory to said chair includes a means for connecting said front surface to said rear surface.

6. The accessory as claimed in claim 3 wherein said rear surface defines a plurality of storage pockets.

7. The accessory as claimed in claim 3 wherein said support means defined on said front surface includes a pillow.

8. The accessory as claimed in claim 7 wherein said support means on said front surface includes a back support.

9. The accessory as claimed in claim 3 further including at least one carrying strap attached to said accessory.

10. The accessory as claimed in claim 9 further including at least two straps attached to said accessory and said rear surface defining, at least in part, storage means;

means for selectively pivoting said front surface relative to said rear surface between a retracted position in which said front surface is substantially adjacent to said rear surface, an extended position in which said front surface is separated from said rear surface, said front surface providing a sun cover for an occupant of said chair to which said accessory is mounted when said front surface is pivoted into its extended position.

11. The accessory as claimed in claim 3 wherein said means for removably mounting said accessory to said chair includes first mounting means connecting the top edge of said front surface to the top edge of said rear surface.

12. The accessory as claimed in claim 11 wherein said first mounting measn is loop-shaped for engaging a top edge of the backrest of a chair to which said accessory is mounted.

13. The accessory as claimed in claim 11 wherein said means for mounting includes at least one side mounting element connecting a side edge of said front surface to a side edge of said rear surface.

14. The accessory as claimed in claim 13 wherein said side mounting element is loop-shaped for engaging a side edge of the backrest of a chair to which said accessory is to be mounted.

* * * * *

402-117

UNITED STATES PATENT AND TRADEMARK OFFICE

CERTIFICATE OF CORRECTION

PATENT NO. : 5,727,841

DATED : March 17, 1998

INVENTOR(S) : Brian D. Morley

It is certified that error appears in the above-identified patent and that said Letters Patent is hereby corrected as shown below:

Claim 10, Line 2: After "and", delete the remaining portion of the claim and substitute - -arranged relative to each other such that said accessory can be carried as a backpack- -.

Signed and Sealed this

Second Day of June, 1998

*Attest:*

Bruce Lehman

BRUCE LEHMAN

*Attesting Officer*

*Commissioner of Patents and Trademarks*